United States Patent [19]

Staerzl

[11] 4,322,633

[45] Mar. 30, 1982

[54] MARINE CATHODIC PROTECTION SYSTEM

[75] Inventor: Richard E. Staerzl, Fond du Lac, Wis.

[73] Assignee: Brunswick Corporation, Skokie, Ill.

[21] Appl. No.: 59,192

[22] Filed: Jul. 19, 1979

[51] Int. Cl.[3] ..... H01B 7/28

[52] U.S. Cl. ..... 307/95; 204/196; 204/147

[58] Field of Search ..... 307/95; 205/195 C, 196, 205/147

[56] References Cited

U.S. PATENT DOCUMENTS 3,769,521 10/1973 Caldwell et al. ..... 307/95

3,953,742 4/1976 Anderson et al. ..... 307/95

OTHER PUBLICATIONS

Signetics, Digital Linear MOS Data Book, 1974, pp. 6.58–6.62, Precision Voltage Regulator.

*Primary Examiner*—Michael L. Gellner

*Assistant Examiner*—James L. Dwyer

*Attorney, Agent, or Firm*—Andrus, Sceales, Starke & Sawall

[57] ABSTRACT

A marine cathodic protection system maintains a submerged portion of a marine drive unit at a selected potential to reduce or eliminate corrosion thereto. An anode is energized to maintain the drive unit at a preselected constant potential in response to the sensed potential at a closely located reference electrode during normal operations. Excessive current to the anode is sensed to provide a maximum current limitation. An integrated circuit employs a highly regulated voltage source to establish precise control of the anode energization.

2 Claims, 2 Drawing Figures

MARINE CATHODIC PROTECTION SYSTEM

BACKGROUND OF THE INVENTION

This invention relates to a cathodic protection system to maintain a submersible metal unit of a marine transportation system at a selected potential to reduce or eliminate corrosion thereto.

Marine drive units are commonly formed of metal such as aluminum for example which may become corroded when subjected to various operating environments, such as within salt water. Known systems have supplied controlled amounts of energy to an anode positioned in close proximity to the drive unit in response to the sensed potential monitored by a reference electrode also positioned in close proximity to the drive unit. In such manner, controlled amounts of energy are supplied to maintain the drive unit at a prescribed protective polarization to retard or prevent corrosive action. One desirable cathodic protection system is disclosed in U.S. Pat. No. 3,953,742 to Edward P. Anderson and Mark Harris, and is assigned to a common assignee herewith.

SUMMARY OF THE INVENTION

A control circuit selectively supplies controlled amounts of energy from an energy source through a connecting circuit to an anode to maintain a preestablished potential at a submersible metal unit of a marine transportation system in response to the energy sensed at a reference electrode.

The energy supplied to the anode is sensed to maintain the anode current within a pre-established maximum limitation. The control of the energy to the anode is highly regulated and independent of variations in the energy source and functions with low energy consumption.

DESCRIPTION OF THE ILLUSTRATED EMBODIMENT

Figure 1:
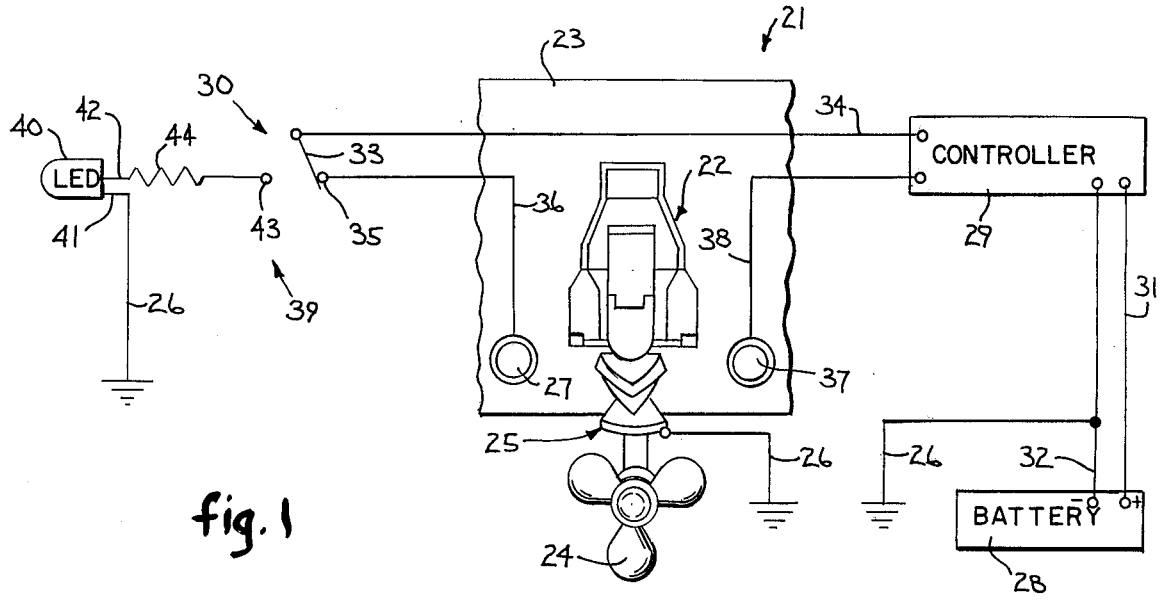
FIG. 1 is a diagrammatic illustration of a portion of a marine transportation system and illustrates a cathodic protection system for a marine drive unit.
Figure 2:
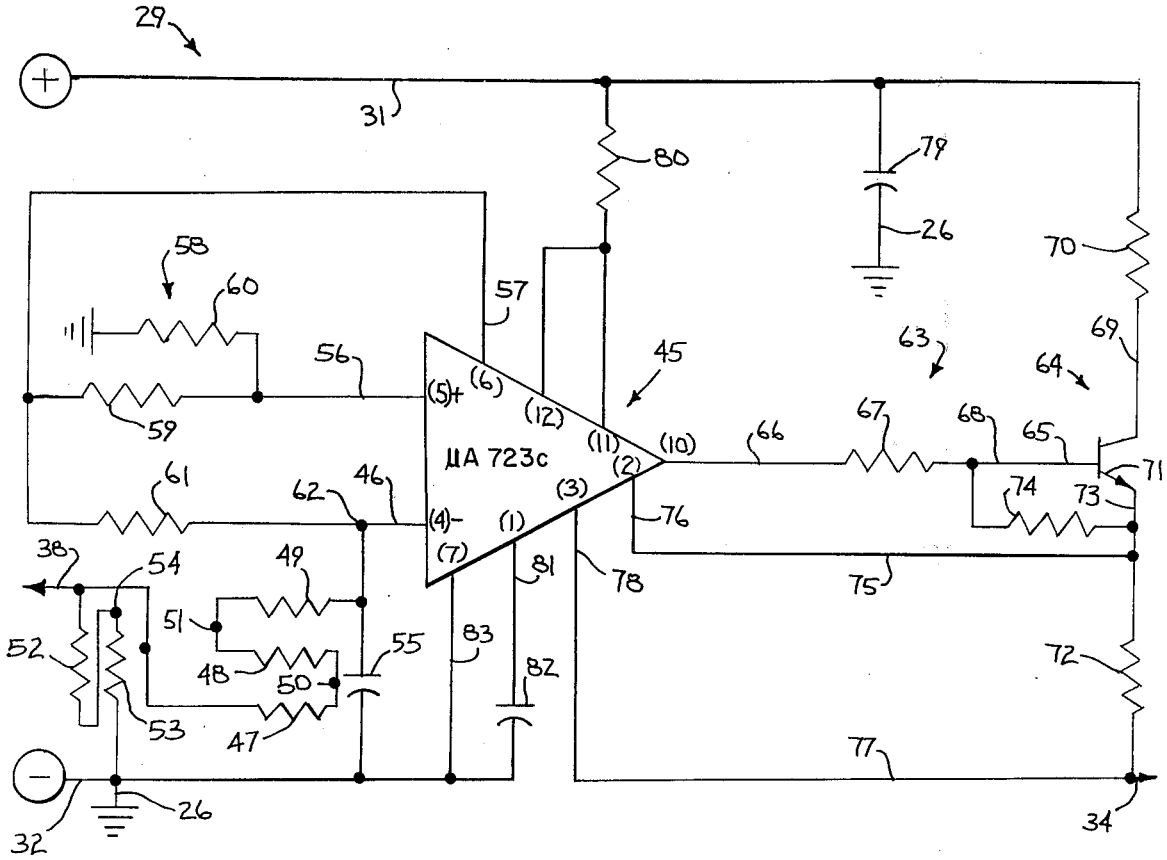
FIG. 2 is a schematic circuit diagram of the controller in FIG. 1.

A marine transportation system 21 is partially illustrated and includes a marine drive unit 22 connected to boat transom 23. The drive unit 22 includes a propeller 24 rotatively mounted to a housing 25 and is selectively operated by an engine (not shown) to control the position and movement of the boat in water. The drive unit 22 may be of any known form such as an outboard engine, a stern drive, or a direct drive or inboard construction. The drive unit 22 or portions thereof may be formed of aluminum or other suitable metal and forms a common ground as illustrated at 26 for the electrical circuit of the cathodic protection system.

An anode 27 is connected in electrical isolation to the transom 23 and receives energizing power from a battery 28 as supplied through a controller 29 and a test control switch 30. Thus, the positive battery terminal is connected to the controller 29 through a connecting circuit 31 while the negative battery terminal is connected through a circuit 32 to the system ground 26 and to the controller 29. A switch arm 33 of switch 30 is connected to the controller 29 through a connecting circuit 34 while a terminal 35 of switch 30 is connected to the anode 27 through a connecting circuit 36. A reference anode 37 is connected in electrical isolation to the transom 23 and provides a sensed potential signal to controller 29 through a connecting circuit 38.

A test circuit 39 includes a light emitting diode (LED) 40 having one terminal 41 connected to the system ground 26 and an energizing terminal 42 connected to a terminal 43 of switch 30 through a connecting resistor 44.

In operation, the anode 27 and the reference electrode 37 are positioned below the water line adjacent to the housing 25 and propeller 24. The controller 29 responds to the sensed potential signal received from the reference electrode 37 and supplies energizing current through circuit 34 and switch 30 to energize the anode 27 to provide and maintain a protective polarization at the drive unit 22 to retard or prevent corrosive action which might otherwise be caused by the water or elements therein. The controller 29 functions to maintain a substantially constant polarization potential at the drive unit 22 when operating within a prescribed current conducting condition.

The switch arm 33 may be selectively transferred from contact 35 to contact 43 to perform a test sequence. In such condition, the flow of energizing power from controller 29 through connecting circuit 34 energizes the LED 40 to signify that the controller 29 is operating properly.

An integrated circuit 45 within the controller 29 is of the type which may be commercially purchased from any one of a number of manufacturing sources, such as Texas Instruments, for example, under the designation uA723C. An inverting input 46 of the integrated circuit 45 is connected to the reference electrode 37 through connecting circuit 38 and three series connected resistors 47, 48 and 49. A jumper terminal 50 is located between resistors 47 and 48 and a jumper terminal 51 is located between resistors 48 and 49. When connected for operation, an installer may, if desired, connect a jumper (not shown) between the connecting circuit 38 and either of the terminals 50 or 51 to pre-select one or more resistance values according to desired circuit operating conditions found to exist during construction. The connecting circuit 38 is also connected to the system ground 26 through a pair of series connected resistors 52 and 53 coupled through a jumper terminal 54 for permitting an operator to install a jumper (not shown) between terminal 54 and the system ground 26 to preselect an appropriate impedance coupling to ground. The impedance provided by resistors 52 and 53 protects the reference electrode 37 from excessive currents which might otherwise cause damage thereto. A capacitor 55 couples the inverting input 46 to the system ground 26 for providing noise immunity.

A non-inverting input 56 of the integrated circuit 45 is connected to a constant magnitude reference terminal 57 through a voltage divider circuit 58 including resistors 59 and 60. Also, the inverting input 46 is connected to the constant reference voltage terminal 57 through a connecting resistor 61. In effect, a summing circuit 62 is formed at the inverting input 46 where a constant signal from the voltage reference terminal 57 is summed with a sensed potential signal received from the reference electrode 37 through the connecting circuit 38.

An output circuit 63 of the integrated circuit 45 is connected to an NPN type control transistor 64. Specifically, the output 63 is connected to a base circuit 65 of transistor 64 through a connecting circuit 66, a current limiting resistor 67 and a connecting circuit 68. A collector circuit 69 of transistor 64 is connected to the positive terminal of battery 28 through the connecting circuit 31 and a coupling resistor 70. At emitter circuit 71 of transistor 64 is connected to the anode 27 through switch 30, the connecting circuit 34, a current sensing resistor 72 and a connecting circuit 73. A resistor 74 interconnects the base circuit 65 with the emitter circuit 71 of transistor 64 to minimize leakage current therein.

A feedback circuit 75 is connected to the current sensing resistor 72 at the connecting circuit 73 and, in turn, is connected to a current limit input 76 of the integrated circuit 45. A connecting circuit 77 is connected to the resistor 72 at the circuit 34 and, in turn, is connected to a current sense terminal 78 of the integrated circuit 45. The control provided by the coupling circuits 75 and 77 monitors the current flow through the sensing resistor 72 so that the integrated circuit 45 will provide an upper limit upon the control signal supplied at output 63 to effectively provide a current limit upon the anode energizing output supplied by the transistor 64.

The positive potential connecting lead 31 is connected to the system ground 26 through a coupling capacitor 79 to eliminate high frequency transient conditions. The V+ and $V_c$ terminals of the integrated circuit 45 are mutually connected through a connecting resistor 80 to the positive potential circuit 31. A compensation terminal 81 of integrated circuit 45 is connected to the system ground 26 through a compensating capacitor 82 while a V- terminal of the integrated circuit 45 is connected through a circuit 83 to the system ground 26.

In operation, the reference electrode 37 senses the potential at or near a submerged portion of the drive unit 22 and supplies a potential indicative signal to the summing circuit 62 which is summed with a constant signal supplied from the $V_{ref}$ terminal 57 of the integrated circuit 45. The summed signal from circuit 62 is supplied to the inverting input 46 to control the operation of the integrated circuit 45 and thus the operation of the control transistor 64. If the potential sensed by the electrode 37 is at or above a predetermined magnitude, such as 0.94 volts, for example, the integrated circuit 45 responds by maintaining a turned off condition so that a substantially grounded output is supplied to the base circuit 65 and transistor 64 is maintained in a turned off condition to prevent the flow of energy to the anode 27.

If the potential at the reference electrode 37 decreases below a predetermined magnitude, such as below 0.94 volts, for example, the integrated circuit 45 responds by turning on to supply an increased potential signal to the base circuit 65 thereby rendering transistor 64 conductive. In such condition, energizing current will flow from battery 28 through the connecting circuit 31, resistor 70, transistor 64, resistor 72, and connecting circuit 34 to energize the anode 27 to provide protective polarization to the submerged portion of the drive unit 22. The amount of anode energizing current flow will vary proportionately with the variance in sensed potential at the reference electrode 37 when operating below the pre-set or desired polarizing potential and within pre-established maximum current conditions.

The current flow through the sensing resistor 72 is monitored through the circuits 75 and 77 so that the integrated circuit 45 will respond to an excessive current flow to the anode 27. If excessive anode current is sensed, the integrated circuit 45 decreases the output signal supplied to the base circuit 65 to reduce the amount of conduction by the transistor 64 thereby maintaining the current flow to anode 26 within a predetermined maximum limit or level.

During customary operation, the potential of reference electrode 37 will be maintained at a constant magnitude. If excessive current to the anode is sensed, the magnitude of the control signal supplied to the base 65 of the control transistor 67 is reduced to correspondingly reduce the current flow to the anode 27 to within a prescribed limit.

A highly regulated cathodic protection system maintains a submerged portion of a marine drive at a preselected potential to reduce or prevent corrosion thereof.

I claim:

1. A cathodic protection system to maintain a submergible metal unit of a marine transportation system at a selected potential by selectively supplying electrical energy from a direct current source through a control circuit to a submergible anode located adjacent to the metal unit in response to sensed energy at a submergible reference electrode located adjacent and electrically isolated from the metal unit, wherein the improvement in said control circuit comprises means including a comparator with a first input connected to a highly regulated voltage source to establish a pre-set reference voltage and a second input providing a summing circuit connected to said highly regulated reference voltage source and to said reference electrode through an impedance-to-ground circuit to protect said reference electrode from excessive currents and to sum a reference voltage with a sensed isolated electrode potential signal to provide a controlled output in response to said sensed signal to selectively supply controlled amounts of direct current energy through a connecting circuit to said anode to maintain a pre-established voltage at said metal unit.

2. The cathodic protection system of claim 1, wherein said regulated voltage source provides a substantially constant pre-set reference voltage substantially independent of variations within said source for efficient operation.

* * * * *